US006755100B1

(12) United States Patent
Chen

(10) Patent No.: US 6,755,100 B1
(45) Date of Patent: Jun. 29, 2004

(54) TOOL HAVING QUICK RELEASE AND POSITIVE LOCKING DEVICE

(75) Inventor: Alex Chen, Taichung Hsien (TW)

(73) Assignee: Stanley Chiro International Ltd., Taichung Hsien (TW)

( * ) Notice: Subject to any disclaimer, the term of this patent is extended or adjusted under 35 U.S.C. 154(b) by 0 days.

(21) Appl. No.: 10/328,691

(22) Filed: Dec. 23, 2002

(51) Int. Cl.[7] ..... B25B 23/16
(52) U.S. Cl. ..... 81/177.85; 403/324
(58) Field of Search ..... 81/177.85; 403/379.5, 403/324, 328; 279/86, 93, 94

(56) References Cited

U.S. PATENT DOCUMENTS 3,515,399 A * 6/1970 Wordsworth ..... 279/93
4,571,113 A * 2/1986 Coren ..... 81/177.85
4,794,828 A * 1/1989 Olson ..... 81/177.85
4,848,196 A 7/1989 Roberts ..... 81/177.85

* cited by examiner

*Primary Examiner*—D. S. Meislin
(74) *Attorney, Agent, or Firm*—Charles E. Baxley

(57) ABSTRACT

A tool device includes a diagonally disposed groove and a channel formed in one end and communicating each other, and a latch pin and a button slidably received in the groove and the channel of the tool device. A spring may bias one end of the latch pin out and to engage into a tool member, and to detachably lock the tool device to the tool member. The latch pin may be easily disengaged from the tool member by depressing the button into the tool device. The button has a notch formed between two legs for slidably receiving the latch pin.

7 Claims, 3 Drawing Sheets

TOOL HAVING QUICK RELEASE AND POSITIVE LOCKING DEVICE

BACKGROUND OF THE INVENTION

1. Field of the Invention

The present invention relates to a tool, and more particularly to a tool extension or the like having a quick release and positive locking device.

2. Description of the Prior Art

Typical quick release and positive locking device having been developed and provided for socket wrenches or extension bars for socket wrenches. One example of the typical quick release and positive locking device is disclosed in U.S. Pat. No. 4,848,196 to Roberts.

For example, as shown in FIGS. 1 and 2, Roberts discloses a tool device 10 comprising a movable member 12 slidably received in a diagonally disposed bore 11 or opening thereof, and a spring 13 engaged with the movable member 12 to force one end of the movable member 12 into a cavity 21 of a socket 20 or the like, and thus for locking the socket 20 to the tool device 10, and for preventing the socket 20 from being disengaged from the tool device 10.

However, as shown in FIG. 2, the spring 13 is required to be moved relative to the tool device 10 with fingers, and thus may not be easily moved relative to the tool device 10.

The present invention has arisen to mitigate and/or obviate the afore-described disadvantages of the conventional tools.

SUMMARY OF THE INVENTION

The primary objective of the present invention is to provide a tool device including a quick release and positive locking device that may be easily operated or actuated by the user.

In accordance with one aspect of the invention, there is provided a tool device for attaching to a tool member, the tool device comprising a tool body including a first end having a diagonally disposed groove formed therein, and a channel laterally formed therein and communicating with the groove of the tool body, a latch pin slidably received in the groove of the tool body, and including a first end extendible outwardly of the groove of the tool body, for engaging into the tool member, a first biasing means for biasing the first end of the latch pin out of the groove of the tool body, and a button slidably received in the channel of the tool body, and engageable with the latch pin, to force the latch pin inwardly of the groove of the tool body against the first biasing means when the button is depressed into the channel of the tool body. The latch pin may thus be easily disengaged from the tool member by depressing the button into the tool body against the spring biasing means against the latch pin.

The latch pin includes a peripheral bulge extended radially and outwardly therefrom that defines a shoulder between the rod and the peripheral bulge, the button includes at least one first leg extended therefrom and engageable with the shoulder of the latch pin for moving the latch pin against the first biasing means.

The first leg of the button includes an inclined surface formed thereon and slidably engaged with the shoulder of the latch pin, for allowing the latch pin to be smoothly and effectively moved or forced into the groove of the tool body.

The button includes a second leg extended therefrom and defining a notch between the second leg and the first leg for slidably receiving the latch pin, and for stably and slidably coupling the latch pin to the button.

The button includes a knob having a reduced diameter than that of the button to form a shoulder between the button and the knob. The tool body preferably includes a portion engaged into the outer portion of the channel thereof and engageable with the shoulder of the button, for stably retaining the button within the channel of the tool body, and for preventing the button from being disengaged from the tool body.

Another spring biasing device may further be provided for biasing the knob out of the channel of the tool body.

The first end of the latch pin preferably includes a cone-shaped structure for engaging with the tool member, and for allowing the latch pin to be moved or forced into the tool body when the first end of the tool body is engaged into a bore of the tool member.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 5:
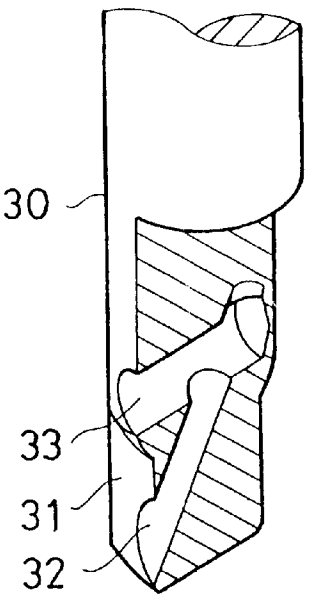
FIG. 5 is a partial perspective view of the tool device, in which a portion of the tool device has been cut off for showing the inner structure of the tool device.
Figure 2:
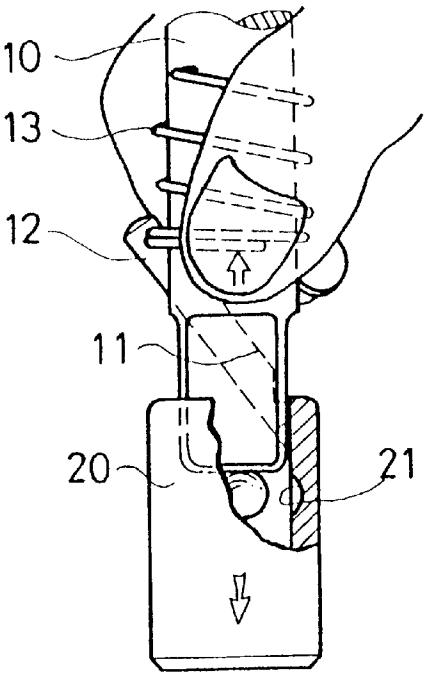
FIG. 2 PRIOR ART
FIG. 2 is a partial cross sectional view similar to FIG. 1, illustrating the operation of the typical quick release and positive locking device for the typical tool device.
Figure 1:
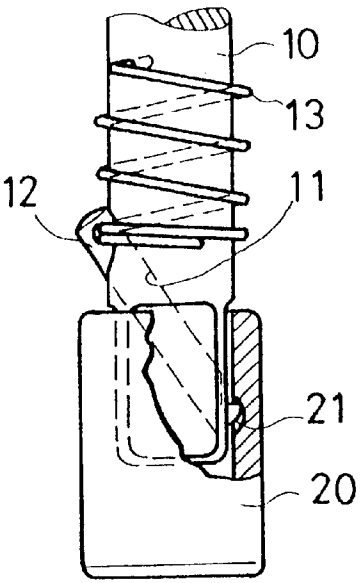
FIG. 1 PRIOR ART
FIG. 1 is a partial cross sectional view showing a typical tool device having a quick release and positive locking device.
Figure 4:
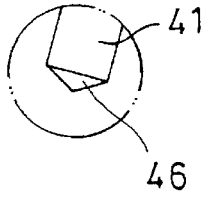
FIG. 4 is an enlarged partial plan view illustrating the end portion of the movable pawl of the tool device.
Figure 3:
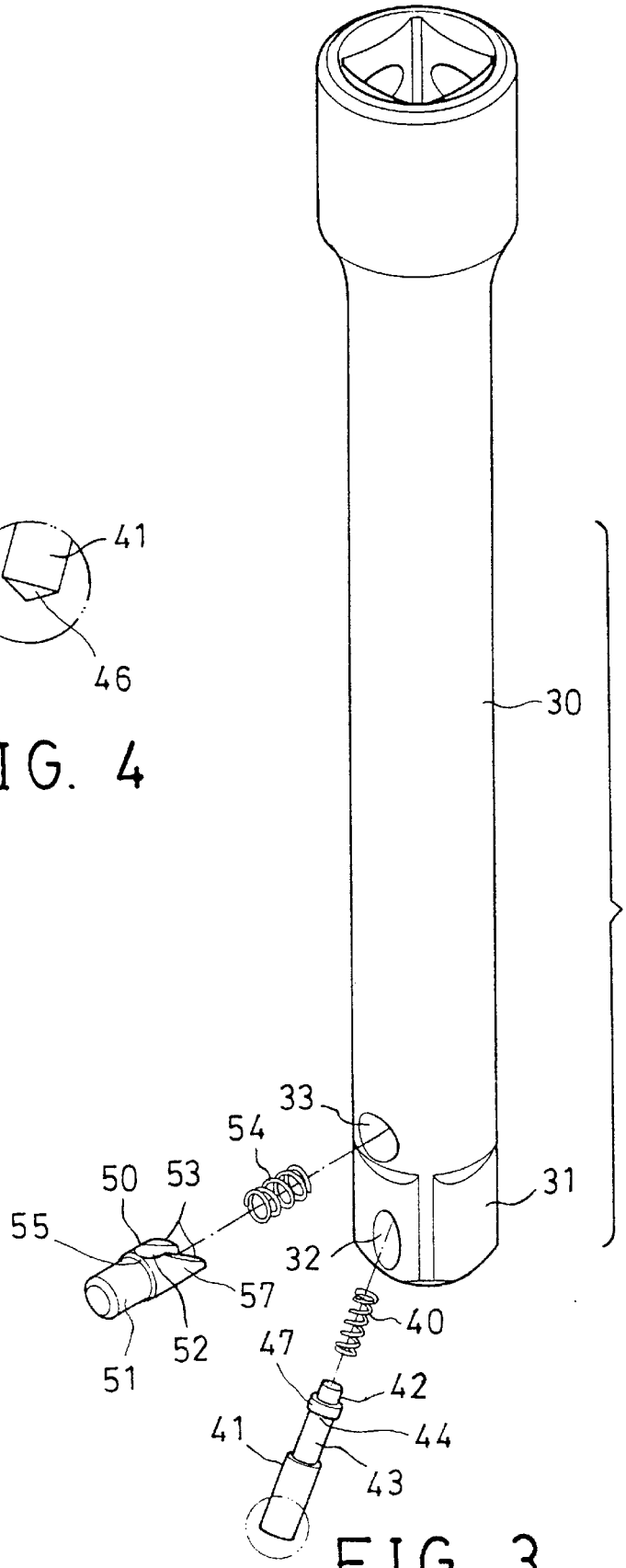
FIG. 3 is an exploded view of a tool device having a quick release and positive locking device in accordance with the present invention.

Referring to the drawings, and initially to FIGS. 3–6, a tool device in accordance with the present invention comprises a tool body or a tool shank 30 including one or more flat surfaces formed or provided on one end 31 thereof, such as the lower end or the free end thereof, which may be engaged into a bore 61 of a tool member 60 (FIGS. 6, 7), such as the tool extensions, the sockets or the like. The other end of the tool body 30 may be attached to and driven by the driving tool (not shown).

The tool body 30 includes a diagonally disposed groove 32 formed therein for receiving a spring member 40 and a latch pin 41 therein. The latch pin 41 preferably includes an inclined end or a cone-shaped end 46 formed therein for allowing the end 46 of the latch pin 41 to be easily engaged into the cavity 62 of the tool member 60 when the lower end 31 of the tool body 30 is engaged into the bore 61 of the tool member 60. The spring member 40 may bias the end 46 of the latch pin 41 into the cavity 62 of the tool member 60 (FIG. 6).

Figure 7:
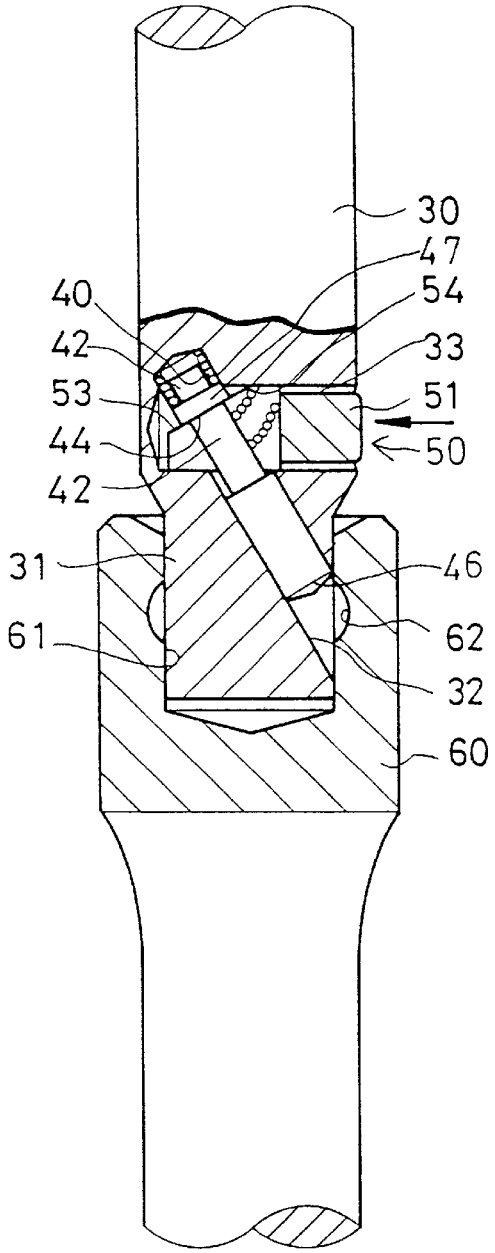
FIG. 7 is a partial cross sectional view similar to FIG. 6, illustrating the operation of the quick release and positive locking device for the tool device.

The latch pin 41 includes a rod 43 extended from the other end thereof and having a reduced diameter than that of the latch pin 41. The rod 43 includes a free end 42 for engaging into one end of the spring 40, and for allowing the spring 40 to be solidly engaged between the latch pin 41 and the tool body 30 (FIGS. 6, 7). The latch pin 41 further includes a peripheral bulge 47 extended radially and outwardly therefrom, for forming or defining a shoulder 44 between the rod 43 and the peripheral bulge 47.

Figure 6:
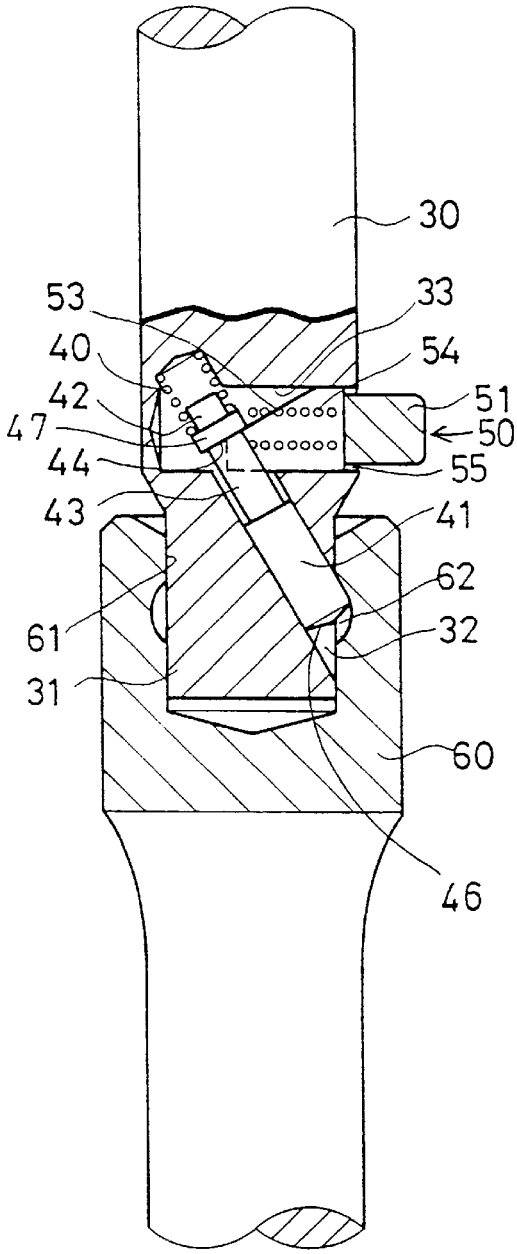
FIG. 6 is a partial cross sectional view of the tool device.

The tool body 30 further includes a channel 33 laterally formed therein and intersecting or communicating with the groove 32 thereof, best shown in FIGS. 5–7, for slidably receiving a button 50 and a spring 54 therein. The button 50 includes a knob 51 having a reduced diameter than that of the button 50, for forming a shoulder 55 between the button 50 and the knob 51.

The tool body 30 may be machined or forged to force some of the materials into the channel 33 thereof for engaging with the shoulder 55 of the button 50, and for stably retaining the button 50 within the channel 33 of the tool body 30, and for preventing the button 50 from being disengaged from the tool body 30. It is preferable that only the knob SI of the button 50 is extendible out of the contour of the tool body 30 (FIG. 6).

The button 50 includes a notch 52 formed therein, or defined between or in one or more legs 57, for slidably receiving the rod 43 of the latch pin 41 within the notch 52 of the button 50. The legs 57 of the button 50 may be slidably engaged with the shoulder 44 of the rod 43 or of the peripheral bulge 47, for moving the latch pin 41 relative to the tool body 30 against the spring 54.

It is preferable that the legs 57 of the button 50 each preferably includes an inclined surface 53 formed thereon for slidably engaging with the shoulder 44 of the rod 43 or of the peripheral bulge 47, and for allowing the latch pin 41 to be easily or smoothly moved relative to the tool body 30 against the spring 54, by the button 50.

In operation, as shown in PIG. 6, the knob 51 of the button 50 may be biased out of the contour of the tool body 30 by the spring 54, and the end 46 of the latch pin 41 may be biased into the cavity 62 of the tool member 60 by the spring 40.

As shown in FIG. 7, when the button 50 is moved and forced into the channel 33 of the tool body 30 against the spring 54, the legs 57 or the inclined surfaces 53 of the button 50 may be engaged with the shoulder 44 of the rod 43 or of the peripheral bulge 47, to smoothly move the latch pin 41 relative to the tool body 30 against the spring 54, in order to disengage the end 46 of the latch pin 41 from the cavity 62 of the tool member 60, and thus for allowing the end 31 of the tool body 30 to be disengaged from the tool member 60.

When the end 31 of the tool body 30 is engaged into the bore 61 of the tool member 60 again, the end 46 of the latch pin 41 may be engaged with the tool member 60 in order to force the latch pin 41 into the groove 32 of the tool body 30, against the spring 40, and thus for allowing the end 46 of the latch pin 41 to be engaged into the cavity 62 of the tool member 60 again.

Accordingly, the tool device in accordance with the present invention includes a quick release and positive locking device that may be easily operated or actuated by the user.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A tool device for attaching to a tool member, said tool device comprising:

a tool body including a first end having a diagonally disposed groove formed therein, and a channel laterally formed therein and communicating with said groove of said tool body, a latch pin slidably received in said groove of said tool body, and including a first end extendible outwardly of said groove of said tool body, for engaging into the tool member, a first biasing means for biasing said first end of said latch pin out of said groove of said tool body, and a button slidably received in said channel of said tool body, and engageable with said latch pin, to force said latch pin inwardly of said groove of said tool body against said first biasing means when said button is depressed into said channel of said tool body.

2. The tool device according to claim 1, wherein said latch pin includes a rod extended therefrom and includes a peripheral bulge extended radially and outwardly from said rod to define a shoulder between said rod and said peripheral bulge, said button includes at least one first leg extended therefrom and engageable with said shoulder of said latch pin for moving said latch pin against said first biasing means.

3. The tool device according to claim 2, wherein said at least one first leg of said button includes an inclined surface formed thereon and slidably engaged with said shoulder of said latch pin.

4. The tool device according to claim 2, wherein said button includes a second leg extended therefrom and defining a notch between said second leg and said at least one first leg for slidably receiving said latch pin.

5. The tool device according to claim 1, wherein said button includes a knob having a reduced diameter than that of said button to form a shoulder between said button and said knob.

6. The tool device according to claim 5 further comprising a second biasing means for biasing said knob out of said channel of said tool body.

7. The tool device according to claim 1, wherein said first end of said latch pin includes a cone-shaped structure for engaging with the tool member.

* * * * *